United States Patent [19]

Clancy et al.

[11] 4,440,121

[45] Apr. 3, 1984

[54] LOCKNUT DEVICE FOR ENGINE ROCKER ARM ADJUSTMENT

[75] Inventors: Terence J. Clancy, Lake Orion; David G. Kokochak, Royal Oak, both of Mich.

[73] Assignee: General Motors Corporation, Detroit, Mich.

[21] Appl. No.: 373,658

[22] Filed: Apr. 30, 1982

[51] Int. Cl.[3] ..... F01L 1/18

[52] U.S. Cl. ..... 123/90.39; 123/90.41

[58] Field of Search ..... 123/90.41, 90.42, 90.39

[56] References Cited

U.S. PATENT DOCUMENTS

| | | | |
|---|---|---|---|
| 1,832,060 | 11/1931 | Strid | 411/275 |
| 2,562,032 | 7/1951 | Gutensohn | 411/167 |
| 3,087,525 | 4/1963 | Nyswaner et al. | 411/230 |
| 3,251,350 | 5/1966 | Thompson | 123/90.41 |
| 3,880,127 | 4/1975 | Abell, Jr. | 123/90.41 |

FOREIGN PATENT DOCUMENTS

| | | | |
|---|---|---|---|
| 2614 | of 1896 | United Kingdom . | |
| 866872 | 5/1961 | United Kingdom | 123/90.41 |

*Primary Examiner*—Craig R. Feinberg
*Assistant Examiner*—David A. Okonsky
*Attorney, Agent, or Firm*—Arthur N. Krein

[57] ABSTRACT

A nut lock device for use in an engine valve train of the type wherein a rocker arm is pivotable about a fulcrum member to effect opening and closing movement of a spring biased poppet valve, the fulcrum member being supported on a support stud and retained thereon by a retainer nut threaded on the support stud, the improvement wherein the bearing surface of the retainer nut is inclined at an angle to a plane extending at right angles to the axis of the support stud and, wherein the nut reaction surface on the fulcrum member is inclined in a complementary manner to that of the retainer nut for mating engagement therewith whereby to define a cam lock preventing rotation of the retainer nut relative to the support stud during engine operation.

3 Claims, 4 Drawing Figures

LOCKNUT DEVICE FOR ENGINE ROCKER ARM ADJUSTMENT

FIELD OF THE INVENTION

This invention relates to locknut devices for use with rocker arm assemblies or similar devices and, in particular, to a locknut and associated fulcrum member as for the rocker arm in the valve train of an internal combustion engine.

DESCRIPTION OF THE PRIOR ART

A common type of valve train, as used in internal combustion engines for vehicles, has a rocker arm mounted for pivotable movement about a fulcrum member supported on a vertically disposed support stud, that is fixed at one end to the cylinder head of the engine and which is provided with external threads of a predetermined pitch at its opposite or free end. The rocker arm is located so that one end thereof abuts against the stem of an associate valve that is normally biased to its closed position by means of a valve return spring and, the opposite end of the rocker arm is positioned so as to be engaged by one end of an associate push rod. The opposite end of the push rod is operatively engaged by the plunger of a hydraulic valve lifter operatively engaging an associated cam on the cam shaft of the engine. The rocker arm is thus operatively located relative to the valve and push rod by the fulcrum member which, in turn, is axially positioned on the support stud by means of an adjustable retainer nut.

It is common practice in this type of valve train to use a support stud with external threads of a predetermined pitch and, to accordingly design both the rocker arm and the hydraulic valve lifter, so that when the rocker arm retainer nut is torqued down on the support stud so as to just remove all play from the valve train, one full additional turn of the retainer nut will then effect substantial centering of the plunger of the lifter within the lifter body.

In one arrangement of the above-described type valve train, the fulcrum member is in the form of a horizontally disposed shaft having bearings operatively associated with the opposite ends thereof so as to rotatably support the rocker arm for pivotable movement about the axis of the fulcrum member shaft. In a similar manner, as described hereinabove, the fulcrum member shaft, disposed on the support stud, is fixed against axial movement in one direction by means of a retainer nut threaded onto the support stud. After the retainer nut has been axially positioned, as desired, on the support stud it is then locked to prevent rotation relative to the support stud by suitable means, such as a jam type locknut or, as shown, for example in U.S. Pat. No. 3,251,350 entitled Rocker Arm and Mounting Thereof, issued May 17, 1966 to Marion Lee Thompson, by means of a key threaded into the retainer nut which, for this purpose, is in the form of an elongated sleeve nut.

It will be apparent that either of the above-described lock means for the retainer nut requires the use of a separate lock element and, in addition, the use of such separate element can thus add to the effective height of the engine.

SUMMARY OF THE INVENTION

The present invention is accordingly directed to providing a unique and advantageous, yet low cost, locknut means which, in the interest of minimizing engine height—an important element in obtaining a low engine profile—has the locking means formed as part of an otherwise conventional retainer nut cooperating in locking engagement with the fulcrum member for the rocker arm in the valve train of an engine.

Accordingly, a primary object of the invention is to provide an improved locknut arrangement wherein a retainer nut in the form of a locknut has an inclined bearing face to serve as a locknut, with the inclined bearing surface cooperating with a complementary inclined reaction face on the fulcrum member for a rocker arm in the valve train of an engine.

Another object of the invention is to provide an improved locknut structure which includes a retainer nut in the form of a locknut provided with a bearing surface inclined at an angle relative to a plane perpendicular to the axis of a support stud on which the retainer nut is threaded, the associate spring biased fulcrum member having a reaction surface similarly inclined for cooperating with the retainer nut to, in effect, form a cam lock providing locking engagement of the retainer nut against undesired rotation relative to the support stud.

DESCRIPTION OF THE PREFERRED EMBODIMENT

Figure 1:
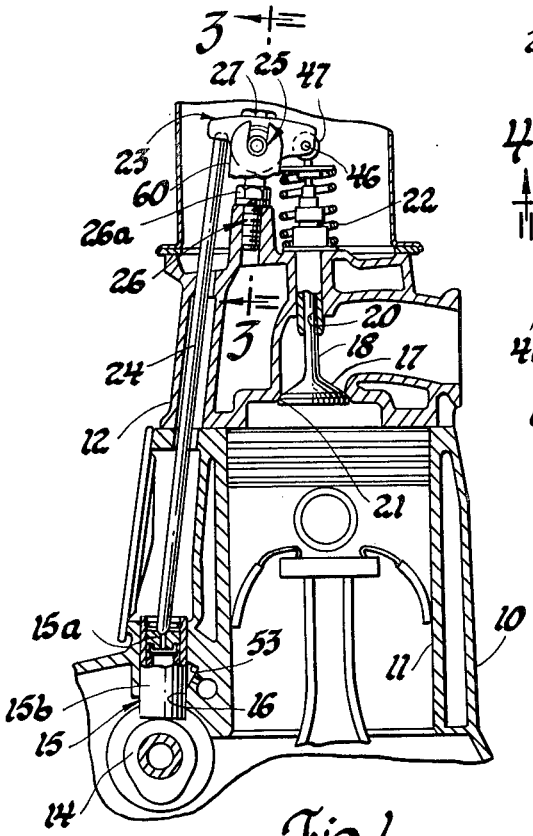
FIG. 1 is a cross-sectional view of a portion of an internal combustion engine illustrating the valve train for a port of the engine and having a locknut device in accordance with the invention incorporated therein, the push rod, support stud and, the valve being shown in elevation.
Figure 2:
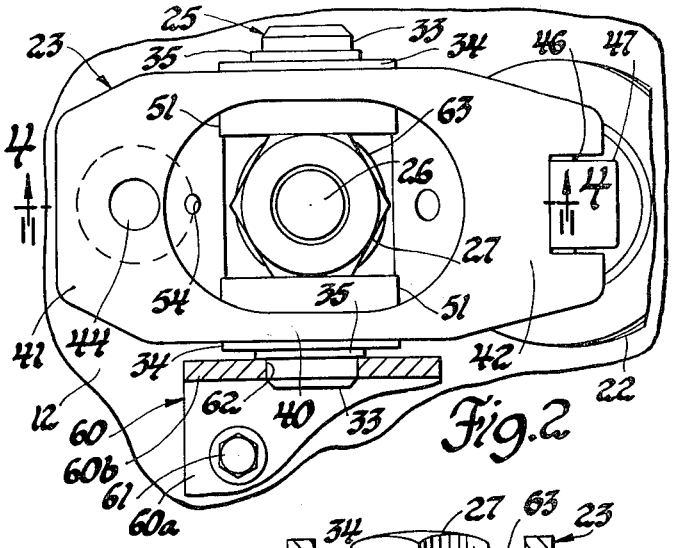
FIG. 2 is a top view of a portion of the engine shown in FIG. 1.

Referring now first to FIG. 1, the engine shown includes a cylinder block 10 in which one or more cylinders 11 are provided and closed at their upper ends by a cylinder head 12. Suitably journaled in the crank case is an engine driven cam 14 which operatively engages a self-adjusting lifter, such as the conventional hydraulic valve lifter 15 shown, so as to cause it to reciprocate in a suitable support shown as a bore 16 formed in the cylinder block and crank case 10. The hydraulic valve lifter 15 may, for example, be of the type shown in U.S. Pat. No. 3,450,228, entitled Hydraulic Valve Lifter, issued June 17, 1969 to D. E. Wortman et al. Since both the construction and operation such type hydraulic valve lifter is well known, it is not deemed necessary to describe it in detail herein, although reference to certain elements thereof will be made hereinafter.

An engine poppet valve 17 having a stem 18 is reciprocably supported in a valve guide bore 20 provided in the cylinder head 12 for movement to open and close a port 21, which can be either an inlet port or an exhaust port. The poppet valve 17 is normally biased to its closed position, the position shown in FIG. 1, by a valve return spring 22. The poppet valve 17 is operatively connected to the tappet 15 by a valve rocker arm 23 and a hollow push rod 24.

The rocker arm 23 is pivotably supported by a fulcrum member 25 which in turn is supported on and operatively fixed to the cylinder head by an upstanding support stud 26 and by a retainer nut 27, the fulcrum member and retainer nut being constructed with a lock-nut arrangement in accordance with the invention in a manner to be described in detail hereinafter.

As is well known in the art, the support stud 26 can be either fixed to the cylinder head 12 as by a press fit into stud bore provided for this purpose in the cylinder head or, as shown, the support stud can be provided at its lower end with external threads 28 for threaded engagement in an internally threaded stud bore 29 formed in the cylinder head 12 in a location in alignment with and intermediate the axes of the push rod 24 and poppet valve 17. For this purpose, in the construction shown, the support stud 26 is provided with an external wrenching head **26*a* next adjacent to the threads 28. At its opposite or upper free end, the support stud is provided with external threads 30** of a predetermined pitch, that is, with a selected number of threads per inch.

Figure 3:
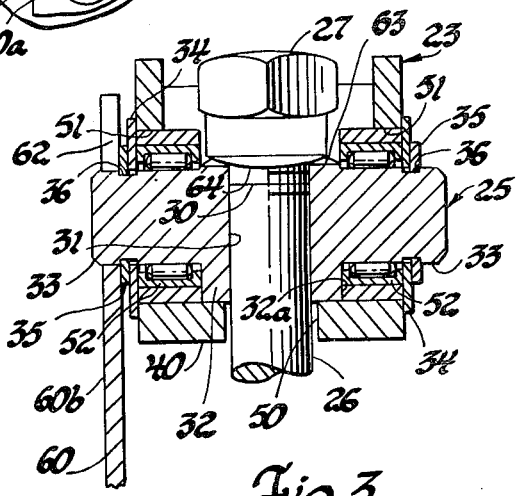
FIG. 3 is a cross-sectional view of the rocker arm and fulcrum member portion of the valve train taken along line 3—3 of FIG. 1; and, FIG. 4 is an enlarged view of the rocker arm assembly and associated elements of the engine assembly shown in FIG. 1.

In the construction illustrated, the fulcrum member 25 is in the form of a horizontally disposed transverse shaft which is provided with a centrally located through bore 31 of a suitable size so as to slidably receive the free end of the support stud 26 therethrough. In the construction shown and as best seen in FIG. 3, the ends of the fulcrum member 25 are of reduced diameters whereby to define a central collar 32 through which the bore 31 extends at right angles to the effective central axis of this collar. With this construction, the reduced diameter ends of the fulcrum member defines, in effect, a pair of oppositely extending stud shafts 33.

Figure 4:
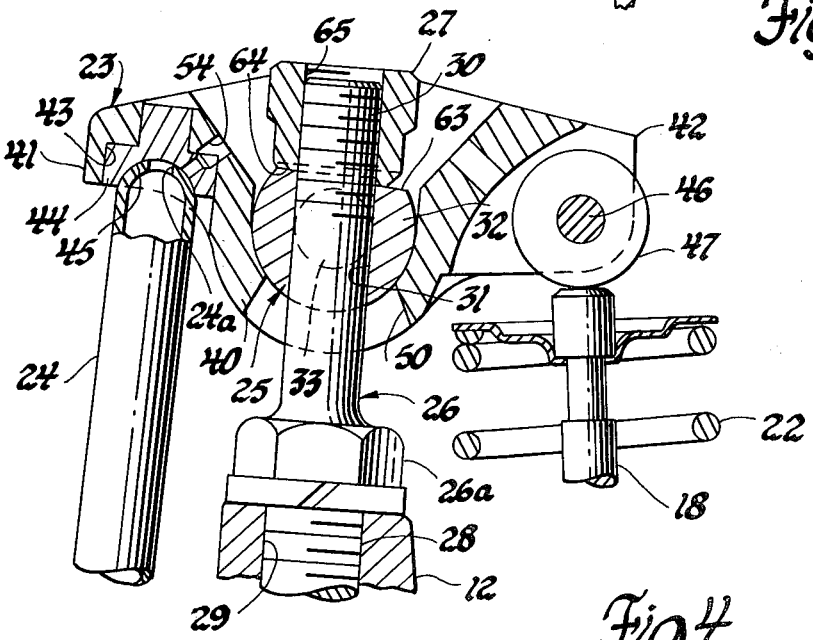

Referring now to the rocker arm 23, in the construction illustrated and as best seen in FIG. 4, this rocker arm has a centrally disposed body portion 40, an arm 41 and an bifurcated arm 42 extending from opposite ends of the body portion 40. Again as best seen in FIG. 4, the arm 41 closely adjacent to its free end is provided with a stepped through bore to define a socket 43 adapted to receive, as by a press fit, an insert 44 that in turn is provided with a hemispherical socket 45 therein to receive the upper end of the push rod 24. The other arm 42, which in the construction illustrated, is of a greater effective length then that of arm 41, is provided with a transverse bore through the bifurcated end thereof so as to receive a pin shaft 46 rotatably supporting a roller 47 in position so as to engage the stem 18 and of the poppet valve 17.

The body portion 40 of the rocker arm 23 is provided with an elongated vertical opening 50 therethrough to loosely receive the support stud 26 in a manner to permit pivotable movement of the rocker arm and, with a transverse bore 51 therethrough of a size so as to receive the outer races of a pair of needle bearings 52, the inner races of these bearings being mounted on the stud shafts 33 of the fulcrum member 24. As shown, each needle bearing 52 is mounted on its associate stud shaft 33 with one end thereof located for abutment against a shoulder **32*a* on the collar 32 and at its opposite end located to abut against thrust washer 34 located by a lock ring 35 positioned in an angular groove 36 provided for this purpose closely adjacent to the outboard free end of the associate stud shaft 33**.

In the construction shown and as best seen in FIG. 4, the push rod 24, of hollow tubular construction, is provided with an aperture **24*a* at its upper spherical end which communicates with the interior of the push rod. The bore of the push rod 24 is provided with pressurized lubrication, such as oil, by means of hydraulic valve lifter 15 from an oil gallery 53 in the cylinder block 10**, in a manner well known in the art, to provide for the lubrication of various elements of the rocker arm assembly.

Oil thus provided via the push rod can flow via a bore extending through both the insert 44 and arm 41, which defines a lubricating passage 54, to the interior of the rocker arm 23 to provide for the lubrication of the bearing 52 and of the roller 47. The manner of supplying oil under pressure to the push rod 24 is conventional and forms no part of the present invention and, therefore, no further description is deemed necessary with respect thereto.

As is conventional, a suitable anti-rotation means is provided to prevent rotation of the fulcrum member 25 about the axis of the support stud 26. For this purpose, in the construction illustrated, there is provided an L-shaped bracket 60 which has the leg **60*a* thereof fixed, as by threaded fasteners 61, to the cylinder head 12 so that the upstanding leg 60*b* thereof, which is provided with an elongated slot 62 of a size to slidably receive the free end of an associate stud shaft 33, is thus positioned to engage that stud shaft and thereby prevent rotation of both the fulcrum member 25 and the rocker arm 23 about the axis of the support stud 26**.

Now in accordance with the invention, the collar 32 of the fulcrum member 25 is provided on its outer peripheral surface with a flat reaction surface 63 surrounding the bore 31 which is inclined as at an angle to a plane extending perpendicular to the axis of the bore 31 and therefore also inclined in the same manner relative to the axis of the support stud 26. In a similar manner, the lower flat bearing surface 64 of the retainer nut 27, which nut is otherwise of conventional construction, is also inclined in a complementary fashion at a corresponding angle to a plane extending at right angles to the axis of the internally threaded bore 65 thereof and thus this bearing surface 64 of the retainer nut will also be inclined relative to the axis of the support stud 26. As should not be apparent, the collar 32 should be of a suitable diameter whereby the reaction surface 63, provided thereon as by machining, will be of a size complementary to the effective diameter of the bearing surface 64 of the associate retainer nut 27 for mating engagement therewith.

With this arrangement, the opposing reaction surface 63 and bearing surface 64 of the fulcrum member 25 and retainer nut 27, respectively, define cam plate surfaces so that during rotation of the retainer nut relative to the fulcrum member on the support stud, these nonperpendicular surfaces, which are, in effect, cam surfaces, will separate (wobble plate fashion) and then come back together again to a mated position as shown. If desired, this mated position can be indicated to an operator, as by providing a suitable positioning mark on both the retainer nut 27 and fulcrum member 25, such positioning marks not being shown.

From the above description of the bearing surface 64 and of the reaction surface 63, it should now be apparent that as the retainer nut 27 is rotated, as from the mated position shown in FIG. 4, for example, the highest edge of its bearing surface 64 will ride along the nonperpendicular face of the reaction surface 63 so that, when the opposed highest rise edges of these surfaces abut each other, as after a 180° rotation of the retainer nut from the position shown, the lowest fall edges of these surfaces, which are, in effect, the fall of these cam surfaces, will be separated by an axial extent corresponding to the combined cam fall from the highest rise edges of these cam surfaces.

It should now be apparent that when the retainer nut 27 is torqued down on the support stud 26, as to the mated position shown against the reaction surface 63 of the fulcrum member 25, the latter will be held in spring biased abutment against the retainer nut 27 by a predetermined force. This force is a result of the force applied by the valve return spring 22 acting through the valve 17 against one end of the rocker arm 23 and by the force of the hydraulic fluid and the usual plunger spring (not shown) of the hydraulic valve lifter 15 acting through the push rod 24 on the other end of the rocker arm. Accordingly, the reaction surface 63, thus biased against the bearing surface 64 of the retainer nut, will cause a cam ramp locking force to be applied against the retainer nut 27 preventing it from any rotation relative to the support stud 26 as a function of both the spring biased force and the effective cam rise as determined by the cam ramp angle of the reaction and bearing surfaces.

Thus in order to provide for a suitable cam-like locking effect on the retainer nut 27 of the size normally used in the valve trains in engines, the minimum cam angle of the bearing and reaction surfaces should be at least 2° and preferably 5° relative to a plane extending perpendicular to the axis of the support stud 26 so as to provide a significant total cam rise and thus to provide a significant reaction force to prevent rotation of the retainer nut, the 5° angle being preferred since inclination of the cam surfaces at 5° angles will be more apparent to an operator than if they were only 2° and thus should indicate to an operator that these surfaces are inclined and thus should be mated, as shown.

It should now, of course, be realized that the greater the angle of inclination of the bearing and reaction surfaces, the higher the total cam rise and therefore the greater cam lock force applied to the retainer nut, up to a preferred maximum angle for these surfaces, as when used in a valve train, for a reason to be described hereinafter.

As is well known, after the installation of a valve train in an engine, the valve train mechanism must then be adjusted to eliminate lash. This is accomplished, in a conventional manner when the associate lifter is positioned on the base circle of the lobe of an associate cam 14, as shown in FIG. 1. This is done by first torquing down (tightening) the retainer nut 27 until all lash (play) is eliminated. With each full turn (360° ) of the retainer nut 27, the rocker arm assembly including the fulcrum member 25 advances downward, with reference to the drawings by whatever thread pitch (threads per inch) is used for the mating threads of the support stud and retainer nut. For example, if the support stud is provided with ⅜ inch external threads of 24 threads to the inch, the fulcrum member 25 will be moved axially downward 0.0416 inch on the support stud 26 per each full revolution of the retainer nut thereon. For metric threads such as M8XI.25 or M10XI.5 threads, for example, the axial movement would then be 1.25 mm and 1.5 mm, respectively.

When the lash (play) is removed from the valve train and the nonperpendicular bearing and reaction surfaces 64, 63 of the retainer nut 27 and fulcrum member 25, respectively, are mated together, the position shown in FIG. 4, the next full turn of the retainer nut 27 will force the rocker assembly further toward the cylinder head 12, thereby compressing the valve return spring 22, as these nonperpendicular surfaces separate (wobble plate fashion), since the fulcrum member 25 is prevented from rotating about the support stud 26, as by the bracket 60 previously described until, the retainer nut 27 has been rotated a full 360° with the bearing and reaction surfaces 64, 63 again coming together in mated engagement with each other. Thereafter, the valve return spring 22, acting through the rocker arm 23 and push rod 24, will force the leak down of oil used in the hydraulic valve lifter 15 until the valve train system is in balance, lashless and ready for engine start up, the plunger **15*a* of the valve lifter now being positioned in substantially a central position within the lifter body 15*b***.

It will now be appreciated that with reference to a lock nut device constructed in accordance with the invention that is intended for use in the valve train of an engine, the upper limit of the cam rise of the bearing and reaction surfaces 64, 63 must be maintained as a function of the difference between the valve closed height of the valve return spring 22 and the solid spring height thereof and, more clearly, as a function of the relationship of this difference in spring height relative to the predetermined normal lift of the poppet valve 17.

Accordingly for practical purposes the maximum cam rise, that is the total rise of both the bearing surface 64 and reaction surface 63, as during the rotation of the retainer nut 180° from the position shown, should be substantially less than the height of the valve lift. For practical purposes, it has been determined that, preferably, the angle of inclination of the bearing surface 64 and also of the associate reaction surface 63 from a plane extending perpendicular to the axis of the support stud 26 should not be greater than 17° and preferably not greater than 15° to permit the retainer nut 27 to be used on various classes of engines with a normal range of differing valve lift heights.

Thus for practical purposes as when used in engine valve trains the angle of inclination of the bearing surface 64 of the retainer nut 27 and the complementary reaction surface 63 of an associate fulcrum member 25, from a plane extending perpendicular to the axis of the associate support stud 26 should be in the order of 2° to 17° and preferably 5° to 15°.

The embodiments of the invention in which an exclusive property or privilege is claimed are defined as follows:

1. A reciprocating internal combustion engine of the type having an engine housing defining at least one cylinder with a port, a valve reciprocably mounted to open and close the port and normally spring biased to a port closing position, a valve actuator means, including a self-adjusting lifter, spaced from the valve and movable in the opposite sense to reciprocate the valve, a support stud fixed at one end to the engine housing and having external threads at its opposite free end, a nut threaded onto the support stud, a fulcrum means encircling the support stud and having a reaction surface on one side thereof for abutment against the bearing surface of the nut, an apertured rocker arm positioned by the support stud for engagement by the valve and the valve actuator means and adapted to be actuated in rocking movement about the fulcrum means to reciprocate the valve against the spring bias to open and close the port during engine operation, and a retainer means operatively associated with the fulcrum means to prevent its rotation about the axis of the support stud, the improvement wherein: said reaction surface and said bearing surface of said fulcrum means and said nut, respectively, are each inclined in complement to each other, at an angle of at least five degrees relative to a plane perpendicular to the axis of the support stud whereby to define a cam lock means to prevent rotation of said nut relative to said support stud as a result of engine vibration.

2. A reciprocating internal combustion engine of the type having an engine housing defining at least one cylinder with a port, a valve mounted for reciprocation so as to open and close the port, the valve being normally spring biased to a port closing position, a valve actuator means spaced from the valve and movable in the opposite sense to reciprocate the valve, a support stud fixed at one end to the engine housing and having external threads at its opposite free end, a retainer nut threaded onto the support stud, a fulcrum means encircling the support stud and having a reaction surface on one side thereof for abutment against the bearing surface of the nut, an apertured rocker arm positioned by the support stud for engagement by the valve and the valve actuator means and adapted to be actuated in rocking movement about the fulcrum means to reciprocate the valve against the spring bias to open and close the port during engine operation, and a retainer means operatively associated with the rocker arm to prevent its rotation about the axis of the support stud, the improvement wherein: said reaction surface and said bearing surface of said fulcrum means and said nut, respectively, are each inclined, in a complementary manner, at an angle of approximately 5° to 15° relative to a plane perpendicular to the axis of the support stud whereby when said bearing surface is in substantially full abutment against said reaction surface, said surfaces prevent rotation of said nut relative to said support stud as a result of engine vibration.

3. A reciprocating internal combustion engine of the type having an engine housing defining at least one cylinder with a port, a valve reciprocably mounted for movement from a port closed position to a predetermined lift position relative to the port, a spring operatively positioned to normally bias the valve to a port closing position, a support stud fixed at one end to the engine housing and having external threads at its opposite free end, a nut threaded onto the support stud, a fulcrum means encircling the support stud and having a reaction surface on one side thereof for abutment against the bearing surface of the nut, an apertured rocker arm positioned by the support stud for engagement at one end by the valve, a valve actuator means spaced from the valve and movable in the opposite sense to reciprocate the valve, the valve actuator means engaging the opposite end of the rocker arm and a retainer means operatively associated with the rocker arm to prevent its rotation about the axis of the support stud, the improvement wherein: said reaction surface of said fulcrum means and said bearing surface of said nut, are each inclined in complement to each other, at an angle of at least five degrees relative to a plane perpendicular to the axis of the support stud whereby to define a cam lock means to prevent rotation of said nut relative to said support stud as a result of engine vibration, the maximum combined cam rise of said bearing surface and of said reaction surface being less than the axial extent from said port closed position to said lift position of said valve.

* * * * *